US006289839B1

(12) United States Patent
Flores

(10) Patent No.: US 6,289,839 B1
(45) Date of Patent: Sep. 18, 2001

(54) SKYSTREAMER

(76) Inventor: Isidore Flores, 279 Durand, East Lansing, MI (US) 48823

( * ) Notice: Subject to any disclaimer, the term of this patent is extended or adjusted under 35 U.S.C. 154(b) by 0 days.

(21) Appl. No.: 09/396,591

(22) Filed: Sep. 15, 1999

Related U.S. Application Data

(60) Provisional application No. 60/100,915, filed on Sep. 17, 1998.

(51) Int. Cl.[7] ..... G09F 17/00
(52) U.S. Cl. ..... 116/173; 116/28 R
(58) Field of Search ..... 116/173, 174, 116/28 R

(56) References Cited

U.S. PATENT DOCUMENTS 741,373 * 10/1903 Robertson ..... 116/173
822,405 * 6/1906 Teese ..... 116/173
2,632,269 * 3/1953 Sanders ..... 116/173
3,495,568 * 2/1970 Palinkos ..... 116/173
3,641,693 * 2/1972 Pinnow ..... 116/173
3,686,938 * 8/1972 Binckley ..... 116/28 R
3,948,205 * 4/1976 Korten ..... 116/30
4,876,981 * 10/1989 Barnhart ..... 116/28 R
5,383,420 * 1/1995 Dundorf ..... 116/174
5,400,437 * 3/1995 Koutras ..... 116/173
5,441,267 * 8/1995 Alder ..... 116/173
5,572,945 * 11/1996 Eastaugh ..... 116/173
5,671,480 * 9/1997 Krout et al. ..... 116/173

* cited by examiner

*Primary Examiner*—Andrew H. Hirshfeld
(74) *Attorney, Agent, or Firm*—Sheridan Ross P.C.

(57) ABSTRACT

A flag and pole assembly in which the pole tapers from bottom to top and where the flag extends beyond the top of the pole, such that the flag and pole arch and easily move with little wind and which is visually attractive in conditions with no wind.

16 Claims, 3 Drawing Sheets

SKYSTREAMER

This application claims benefit of Prov. No. 60/100,915, filed Sep. 17, 1998.

FIELD OF THE INVENTION

The present invention, known as the SkyStreamer™, is a unique flag or pennant system. It comprises a flexible pole in combination with a flag, streamer or pennant which work together to achieve a unique visual appearance. It can be displayed in most any location, including but not limited to decks, backyards, patios, businesses or otherwise used as a location or attention grabbing device. It may also be used in parking lots at sporting events to show team affiliation and support.

BACKGROUND OF THE INVENTION

Flags, pennants or streamers are typically displayed in a limited number of ways. Each may be attached along a horizontal or vertical edge to a rigid structure, such as a pole, suspended from a taught rope, such as over a street or intersection, or suspended from the side of a building or other structure. In the latter situation, the flag will remain substantially motionless because the proximity of the building to the flag inhibits the wind from acting upon the flag. In the other situations, the flags or pennants will hang limp and motionless if insufficient wind exists to move them. The size and shape of the flag also factor into the movement of the flag. As can be appreciated, a limp or motionless flag fails to attract attention. In addition, a motionless flag that drapes over itself due to the manner in which it is displayed, hides some or large portions of the flag, thereby defeating one of the reasons it is displayed. Indeed, if the flag or pennant is intended for advertising, it is disadvantageous for the flag to cover itself or to be motionless.

SUMMARY OF THE INVENTION

The present pennant or flag system provides a distinct physical characteristic unique for this invention. It is designed and intended to mimic the physical characteristics of bamboo, in that the top portion of the pole arches and sways in the presence of a small breeze. By attaching a pennant or flag to the pole, a unique visual effect is created which sets apart the present invention from any rigid flag pole assembly. Even when there is no wind, the upper portion of the flag causes the upper portion of the pole to flex and provides an accentuated visual effect. When the wind blows, the pole and flag rise and dance in unison. The stoop-over effect is an important feature of the system in that it provides eye appeal when the wind is not blowing or when the wind velocity is small.

The term "flag" includes not only a traditional rectangular flag, but also two and three dimensional displays of different geographic shapes such as triangular pennants, elongated banners and wind socks. The preferred embodiment is a right triangle in which the tip extends beyond the end of the pole.

DETAILED DESCRIPTION OF THE PREFERRED EMBODIMENT

Figure 1:
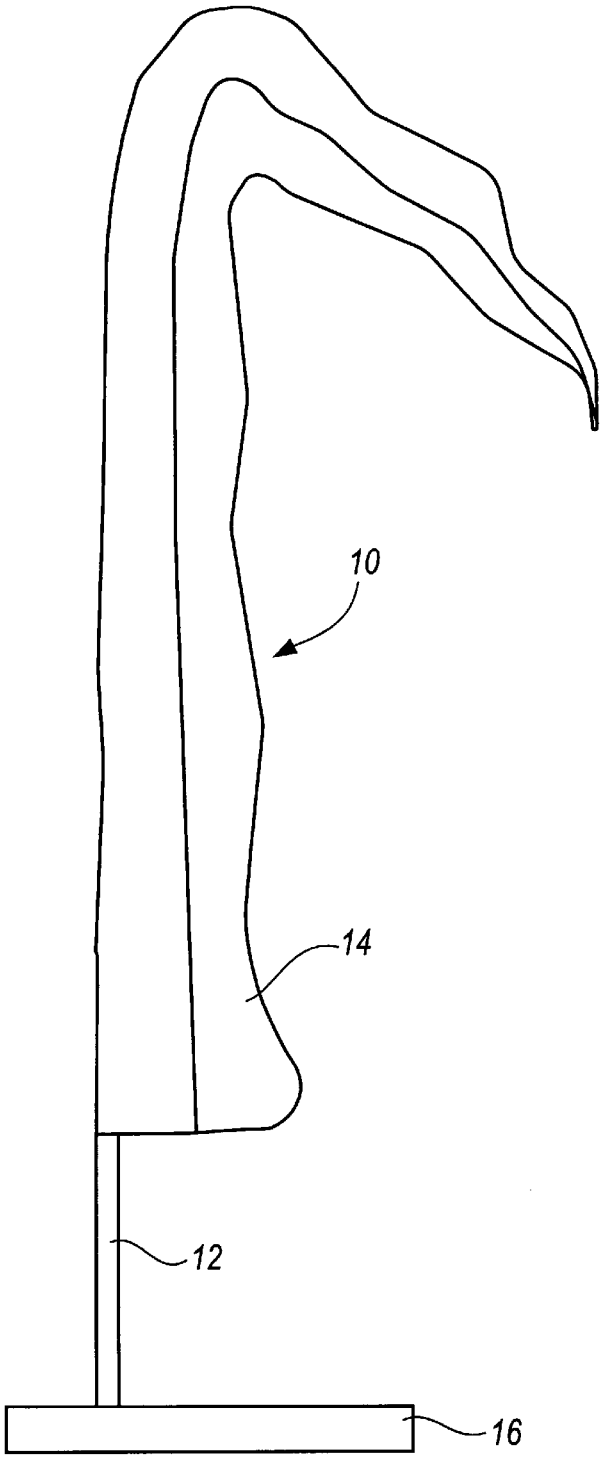
FIG. 1 is a front plan view of the flag or pennant system of the present invention.
Figure 2:
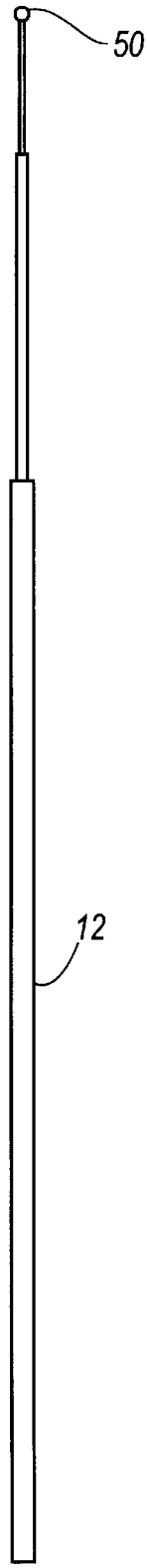
FIG. 2 is a front plan view of an assembled pole of the present invention.

The present flag or pennant system 10 is generally comprised of a pole 12 and a flag, streamer or pennant 14. A base 16 may be utilized to secure the pole 12. (See FIG. 1.) In the preferred embodiment the pole 12 is made from separate sections of rod or tubing. It is appreciated that the pole can be made from metal, wood, plastics or composites such as fiberglass. To provide added strength, particularly at the base, the sections may be solid or hollow, and, if hollow, reinforced with an internal sleeve. If made from fiberglass, additional strength can be achieved if the fibers overlap. Preferably, the base portions are a pultruded fiberglass for strength purposes. As shown in FIG. 2, the pole sections decrease generally in diameter to provide a tapered pole from top to bottom. The upper sections may preferably be of wound fiberglass to provide a spring or flexibility to the upper portion of the pole. Of course, it should be appreciated that the flag pole can be one single piece, instead of multiple sections.

Figure 3:
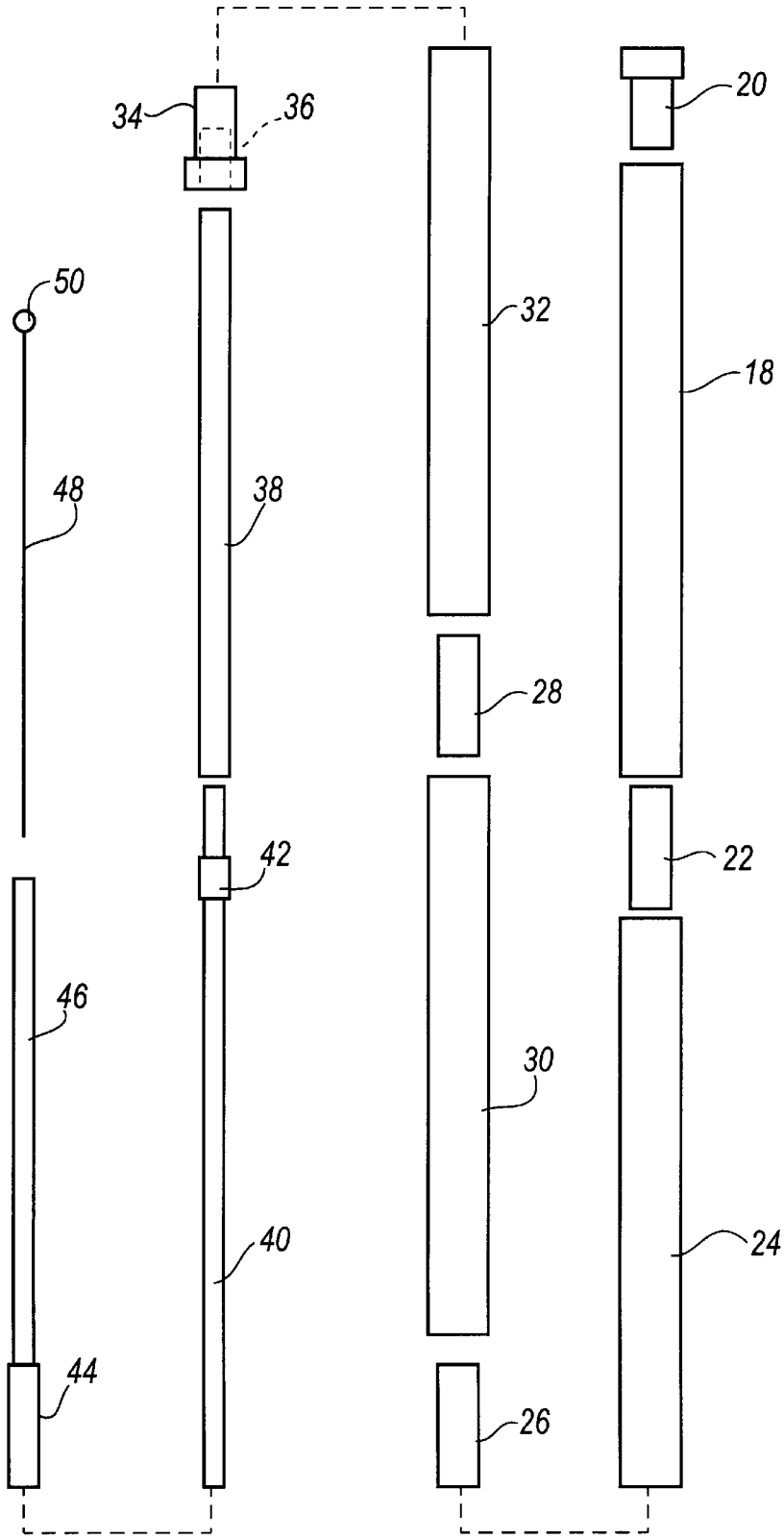
FIG. 3 is a front plan of a disassembled flag pole showing the various components in position for assembly.

Turning to FIG. 3, the component pieces or sections of the pole 12 are illustrated as disassembled. It should be appreciated that the pole may comprise more or less component pieces than are shown. In this embodiment, the base section 18 of the pole 12 receives an end plug 20 at its bottom open end. At the opposite end of base section 18, a ferrule or bushing 22 is inserted into the open end. Up to half of the ferrule 22 is positioned inside the base section 18 in order that the remaining portion of the ferrule 22 can receive the next section 24 of pole 12. Additional ferrules 26, 28 are utilized to connect further pole sections 30, 32 in the same fashion. While the ferrules 22, 26 and 28 are illustrated as having a uniform diameter, they may have two different diameters to accommodate joining pole sections of different diameters. The ferrules may be solid, hollow, cylindrical or any other geometrical shape and cross-section. Similarly, when it is desired to make a transition in the size of pole sections, a ferrule 34 may have a hollow center portion 36 to accommodate a pole section 38 of smaller diameter than the preceding pole section. The pole sections may also be sized or dimensioned to fit one within another without the use of a ferrule or bushing. For example, pole section 40 is illustrated to fit within an open end of pole section 38. A stop 42 may be affixed to pole section 40 to limit the extent that pole section 40 is inserted into pole section 38. A stop may also be added to the inside of pole section 38 to serve the same purpose. Similarly, a joining section 44, having dimensions greater than pole sections it receives, can fit on the outside of the pole sections. The second to last pole section 46 includes a hollow tip or cutout at one end to accommodate the last pole section 48. Typically, pole section 48 is a solid section of fiberglass and includes a safety tip 50 to prevent injury.

Based upon the foregoing, it will be understood by a person of ordinary skill in the art that the pole sections can be assembled in a wide variety of ways. In the preferred embodiment, the pole is approximately 26 feet long, and the individual sections range from 24 to 51 inches, as shown in the accompanying drawings.

Figure 4:
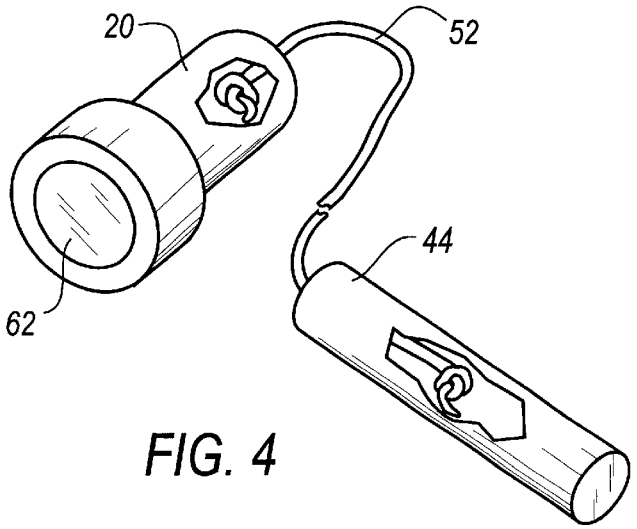
FIG. 4 is a perspective view of a shock cord connecting an end plug and ferrule or bushing.

It is further preferable that an elastic or shock cord 52 is strung inside the pole to provide additional stability to the pole when the sections are assembled. Such a shock cord also assists in assembly of the component pieces. As shown in FIG. 4, the elastic or shock cord 52 can be attached to the base end plug 20 on one end and an upper ferrule or bushing 44 on the other end.

The base 16 of the pole stand is preferably made of a two foot long by ten inch wide by two inch thick piece of plastic. Of course, one of ordinary skill in the art will understand that the purpose of the base is to stabilize the pole for display of the flag. In this regard, the base may be configured in a wide variety of ways. The base may also be configured in order to position the pole in a variety of orientations relative to the base, including but not limited to a vertical orientation.

Figure 6:
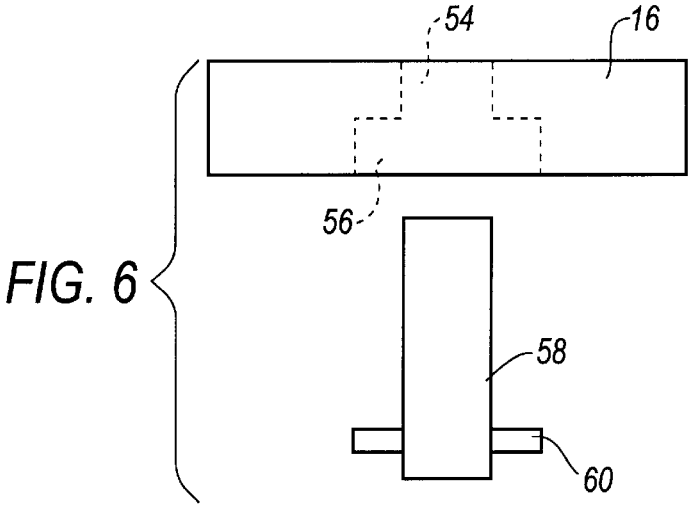
FIG. 6 is a disassembled back plan view of the base section and tube support member.
Figure 5:
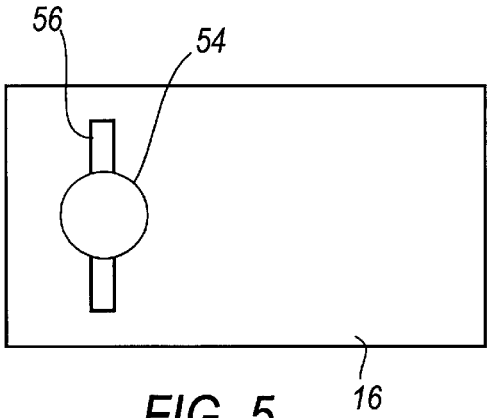
FIG. 5 is a bottom view of the base section.

In the embodiment, illustrated in FIGS. 5 and 6, a hole 54 is positioned close to one end of the base 16. The hole 54 has a notch 56 on the undersurface. The hole 54 accepts a tube 58 that on one end has a cross piece or rod 60 through its diameter which extends out about one-half inch on either side of the tube 58. The stand can be assembled by inserting the tube 58 through the hole 54 in the base 16 from underneath until the cross piece 60 at the bottom of the tube 58 fits into the notch 56 at the bottom of the base 16. This cross piece and notch arrangement keeps the tube 58 from being pulled through the hole 54. The stand may be stabilized by parking a vehicle tire, or placing some other suitable weight, on the base. The base section of the flag pole 12 is then joined with the tube 58. Alternatively, the end plug 20 may include a hollow portion 62 to accommodate the tube 58 or the tube 58 may be sized larger than the diameter of the lowest section 18 so that section 18 and end plug 20 are seated inside the hollow tube 58. Disassembly of the stand is in reverse order of assembly and allows the stand to be stored compactly. The dimensions of the base, tube, and crosspiece set-up can vary according to the dimensions of the flag pole and the physical loads expected by a combination of the size of the flag, the size of the vehicle tire, or the dimensions of some other weight other than a vehicle that would be used to stabilize the base. The material from which the base, tube and cross-piece are made can be wood, plastic, metal or a composite, such as fiberglass.

Figure 7:
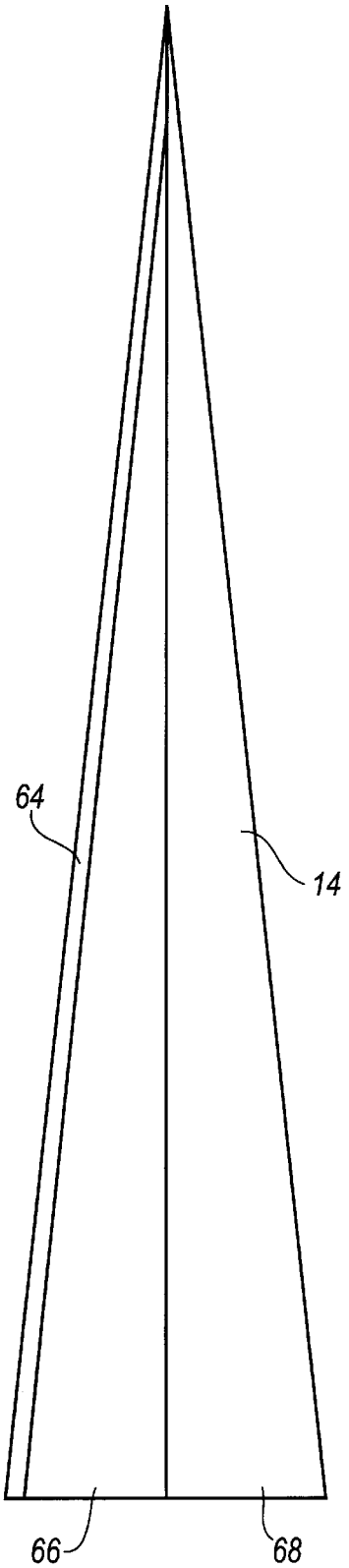
FIG. 7 is a front plan view of a flag, streamer or pennant of the present invention.

With respect to the pennant or flag 14, it is generally triangular in shape. It may be affixed to the pole in many ways known in the art. In the preferred embodiment, shown in FIG. 7, a sleeve 64 runs along one of the side edges of the flag 14. The pole 12 is inserted into the sleeve 64. Also in the preferred embodiment, the flag is widest at its base and narrower at its top where it reaches a point. Generally, the flag may be any geometric shape, but triangular is preferred, and more preferred is a right triangle. It is also preferred that the flag extend along substantially the entire length of the pole, except for a few feet above the ground. The flag may also extend beyond the upper tip of the pole to provide a greater visual effect of an arching and dancing pennant, in which case the sleeve 64 does not extend to the upper end of the flag. In the preferred embodiment, the flag is 28 inches wide at its base, and approximately 24 feet in length. The flag 14 may be also made of multiple panels 66, 68 of different colors to show affiliation or support for an athletic team, may include particular advertising, or may be designed simply for aesthetics. Any design or pattern desired may be incorporated into the flag.

Various embodiments of the present invention have been described in detail. It should be understood that any feature of any embodiment can be combined in any combination with a feature of any embodiment. Furthermore, adaptations and modifications to the described embodiments will be apparent to those skilled in the art. Such modifications and adaptations are expressly within the scope of the present invention as set forth in the following claims.

What is claimed is:

1. A pennant display, comprising:

a flexible elongate pole extending between a stationary base portion and an upper portion, said elongate pole able to bow in substantially any direction at said upper portion;

a pennant affixed to said elongate pole along the length of said elongate pole;

wherein the weight of said pennant causes said upper portion of said elongate pole to bend into an arch independent of any other influence when said pole is in a vertical orientation, and when in the presence of a light or moderate wind, said elongate pole bends and said pennant moves in multiple directions.

2. The display of claim 1, wherein the pennant extends beyond the upper portion of said pole.

3. The pennant display of claim 1; wherein said pole comprises multiple pole sections connected by an elastic member to maintain said pole sections in the proper order of assembly.

4. The pennant display of claim 1, wherein said pennant extends beyond the end of said upper portion of said elongate pole.

5. The pennant display of claim 1, wherein said pennant is affixed to a substantial portion of said elongate pole.

6. The pennant display of claim 1, wherein said elongate pole is at least 20 feet long.

7. A pole and flag assembly comprising:

an elongate pole which is substantially rigid at its base and gradually tapers to a flexible portion at its tip;

a flag having a width and a length, the length being greater than the width, said flag further having a non-curvilinear leading edge along its length, said flag loosely affixed to said pole along said leading edge, with a portion of said flag extending beyond said tip of said pole;

wherein said pole is substantially straight when said flag is not affixed to said pole and, when said flag is affixed to said pole and said pole is in a vertical orientation, the upper portion of said pole bends into an arch solely due to the weight of said flag and independent of the shape of said flag, and the upper portion of said pole and said flag are free to bend in substantially all directions under the influence of the wind.

8. The assembly of claim 7, wherein the pole is made of multiple sections.

9. The assembly of claim 8, wherein said multiple sections increase in flexibility from said base to said tip.

10. The assembly of claim 8, further comprising an elastic cord disposed interior of said multiple sections to assist in assembling and securing said sections into said elongate pole.

11. The assembly of claim 7, wherein said flag is generally triangular and is provided with a sleeve along said leading edge for connection with the pole.

12. The assembly of claim 11, wherein said flag is in the shape of a right triangle.

13. The assembly of claim 11, wherein said sleeve extends along a substantial portion of said leading edge of said flag.

14. The assembly of claim 7, wherein said flag is provided with a sleeve along a substantial portion of its length for attaching said flag to said pole.

15. The assembly of claim 7, wherein said elongate pole is at least 20 feet long.

16. The assembly of claim 7, wherein said sleeve is affixed to a substantial portion of said elongate pole.

* * * * *